US009187217B2

(12) United States Patent
Bisio

(10) Patent No.: US 9,187,217 B2
(45) Date of Patent: Nov. 17, 2015

(54) CAP FOR CONTAINER PROVIDED WITH GUARANTEE SEAL

(71) Applicant: Guala Pack S.p.A., Castellazzo Bormida (IT)

(72) Inventor: Luigi Bisio, Alessandria (IT)

(73) Assignee: Guala Pack S.p.A., Castellazzo Bormida (IT)

( * ) Notice: Subject to any disclaimer, the term of this patent is extended or adjusted under 35 U.S.C. 154(b) by 6 days.

(21) Appl. No.: 13/971,866

(22) Filed: Aug. 21, 2013

(65) Prior Publication Data

US 2014/0048536 A1 Feb. 20, 2014

Related U.S. Application Data

(63) Continuation of application No. 12/422,553, which is a continuation of application No. PCT/IT2007/000426, filed on Jun. 15, 2007, now Pat. No. 8,528,757.

(30) Foreign Application Priority Data

Oct. 27, 2006 (IT) ..... BS2006A0190

(51) Int. Cl.
*B65D 53/00* (2006.01)
*B65D 41/34* (2006.01)
*B65D 75/58* (2006.01)

(52) U.S. Cl.
CPC ..... *B65D 41/3433* (2013.01); *B65D 41/3404* (2013.01); *B65D 75/5883* (2013.01)

(58) Field of Classification Search
CPC ..... B65D 41/3404; B65D 41/3433; B65D 75/5883
USPC ..... 220/304; 215/252, 307, 258; 222/92, 222/153.06
See application file for complete search history.

(56) References Cited

U.S. PATENT DOCUMENTS

D199,440 S 10/1964 Jones et al.
3,601,273 A 8/1971 Kutcher (Continued)

FOREIGN PATENT DOCUMENTS

EP 0688724 B1 12/1995
EP 1407977 A1 4/2004

(Continued)

OTHER PUBLICATIONS

Communication issued by the European Patent Office dated Dec. 5, 2013 concerning the observations by a third party concerning the patentability of corresponding European Patent Application No. 07790158 (7 pages).

(Continued)

*Primary Examiner* — Anthony Stashick
*Assistant Examiner* — James Way
(74) *Attorney, Agent, or Firm* — Harness, Dickey & Pierce, PLC

(57) ABSTRACT

The object of the present invention is a cap provided with a guarantee seal. The guarantee seal consists of guarantee portions comprising an engagement portion and a connecting portion. The seal further comprises bridges for connecting adjacent guarantee portions to one another and a safety portion that makes the engagement portion integral with the handling portion. The safety portion is structurally suitable for keeping the engagement portion constrained in the broken seal configuration, for preventing the forming of dangerous spikes.

16 Claims, 6 Drawing Sheets

(56) References Cited

U.S. PATENT DOCUMENTS

| | | | |
|---|---|---|---|
| 3,767,077 | A | 10/1973 | Rhoades |
| 3,770,156 | A | 11/1973 | Yates, Jr. |
| 3,812,991 | A | 5/1974 | Wurl |
| 4,480,761 | A | 11/1984 | Aichinger |
| 4,529,096 | A | 7/1985 | Chartier et al. |
| 4,744,479 | A | 5/1988 | Schottli |
| 4,744,480 | A | 5/1988 | Luch et al. |
| 4,796,770 | A | 1/1989 | Begley |
| 4,813,562 | A | 3/1989 | Begley |
| 4,844,272 | A | 7/1989 | Dutt |
| D316,969 | S | 5/1991 | Wiseman et al. |
| 5,040,692 | A | 8/1991 | Julian |
| 5,080,246 | A | 1/1992 | Hayes |
| 5,249,704 | A | 10/1993 | Boetzkes |
| 5,648,037 | A | 7/1997 | Franchet et al. |
| 5,853,095 | A | 12/1998 | Marshall et al. |
| 5,992,661 | A | 11/1999 | Zumbuhl |
| 6,202,871 | B1 | 3/2001 | Kelly |
| 6,264,052 | B1 | 7/2001 | Schmitz |
| 6,327,770 | B1 | 12/2001 | Konefal et al. |
| D467,501 | S | 12/2002 | Tacchella |
| 6,581,792 | B1 | 6/2003 | Limanjaya |
| 6,604,647 | B1 | 8/2003 | Luburic |
| 6,685,061 | B2 | 2/2004 | Wolf et al. |
| 6,729,488 | B2 | 5/2004 | McNary et al. |
| 6,811,047 | B1 | 11/2004 | Hicks et al. |
| 7,097,058 | B2 | 8/2006 | Wellman et al. |
| D529,382 | S | 10/2006 | Mineau |
| D531,503 | S | 11/2006 | Beaver et al. |
| D547,657 | S | 7/2007 | Tacchella |
| 7,413,097 | B1 | 8/2008 | Adams |
| 7,513,377 | B1 | 4/2009 | Culley |
| 7,575,123 | B2 | 8/2009 | Laveault et al. |
| D679,597 | S | 4/2013 | Tamarindo |
| 8,528,757 | B2 | 9/2013 | Bisio |
| 9,016,473 | B2 | 4/2015 | Tamarindo |
| 2002/0088814 | A1 | 7/2002 | Belfance et al. |
| 2004/0200797 | A1 | 10/2004 | Hicks et al. |
| 2005/0045578 | A1 | 3/2005 | Schwarz et al. |
| 2006/0043056 | A1 | 3/2006 | Lee |
| 2009/0152269 | A1 | 6/2009 | Pucci |
| 2009/0223963 | A1 | 9/2009 | Bisio |

FOREIGN PATENT DOCUMENTS

| | | | |
|---|---|---|---|
| EP | 1 676 783 | A1 | 7/2006 |
| JP | 10-181758 | | 7/1998 |
| JP | 2002-104447 | | 4/2002 |
| JP | 2004-231229 | | 8/2004 |
| JP | 2004-331124 | | 11/2004 |
| WO | WO 2004/045977 | A1 | 6/2004 |
| WO | WO 2004/108545 | A1 | 12/2004 |

OTHER PUBLICATIONS

International Search Report received in corresponding International Patent Application No. PCT/IT2007/000426 dated Oct. 22, 2007 (3 pages).

Communication issued by the European Patent Office dated Feb. 10, 2012 concerning the observations by a third party concerning the patentability of corresponding European Patent Application No. 07790158 (9 pages).

Response to the observations by a third party filed with the European Patent Office dated Mar. 8, 2012 (2 pages).

Communication issued by the European Patent Office dated Oct. 2, 2012 concerning the observations by a third party concerning the patentability of corresponding European Patent Application No. 07790158 (8 pages).

Response to the observations by a third party filed with the European Patent Office dated Oct. 31, 2012 concerning European Patent Application No. 07790158 (1 page).

CAP FOR CONTAINER PROVIDED WITH GUARANTEE SEAL

This application is a continuation of U.S. patent application Ser. No. 12/422,553, filed Apr. 13, 2009, which is a continuation of International Application No. PCT/IT2007/000426, filed Jun. 15, 2007, which claims priority from Italian Patent Application No. BS2006A000190, filed Oct. 27, 2006.

FIELD OF THE INVENTION

The present invention relates to a cap for container with guarantee seal, that is a cap provided with a seal which upon the first opening, undergoes breakage, thus indicating the occurrence of the opening or tampering of the container.

BACKGROUND OF THE INVENTION

As known, caps with guarantee seal have become much widespread since they allow the consumer to ensure that the container has not been already opened or tampered. Such guarantee is especially appreciated in the field of containers for alimentary pastas or liquids, for example fruit juices, wherein the opening of the container could cause the deterioration of the contents or sometimes, the introduction of undesired substances in the container.

Fruit juice containers, in particular, are normally used by children, so a set of more or less strict standards according to the Country, prescribe some safety requirements the caps must meet.

The standards usually impose some restrictions on the cap dimensions so as to prevent the possibility that they are swallowed by the children.

For the caps currently known, once the cap is unscrewed the guarantee seal breaks into a set of portions that remain associated to the cap body, so the possibility that such portions are swallowed by the children should be substantially prevented.

However, besides being weakly associated to the cap body, they form spikes that dangerously protrude from the cap body. The spikes could harm hurt the child's eyes or they could be detached from the cap body with the teeth and swallowed.

SUMMARY OF THE INVENTION

The object of the present invention is to make a cap for containers provided with a guarantee seal which should be especially safe to be used even by children.

Such object is achieved by a cap suitable for being associated to a coupling portion of a container and suitable for being disconnected by rotation about an axis of rotation from the coupling portion. The coupling portion comprises resistant elements suitable for engaging the cap.

The cap comprises a handling portion, suitable for being rotated by a user for disconnecting the cap from the container, and a guarantee seal, integral with the handling portion and comprising a plurality of guarantee portions, wherein the seal has breaks in a broken seal configuration.

At least one of the guarantee portions comprises an engagement portion, having at least one engagement element suitable for engaging with the resistant elements of the coupling portion for preventing the rotation of the guarantee seal, and a connecting portion, connected to the engagement portion, having at least one connecting element which makes the connecting portion integral to the handling portion.

The guarantee seal comprises at least one bridge which connects adjacent guarantee portions to one another, the bridge being suitable for breaking by rotation of the handling portion relative to the guarantee seal.

The guarantee seal further comprises a safety portion that makes the engagement portion integral with the handling portion, the safety portion being structurally suitable for keeping the engagement portion constrained in the broken seal configuration.

DESCRIPTION OF THE PREFERRED EMBODIMENTS

Figure 1:
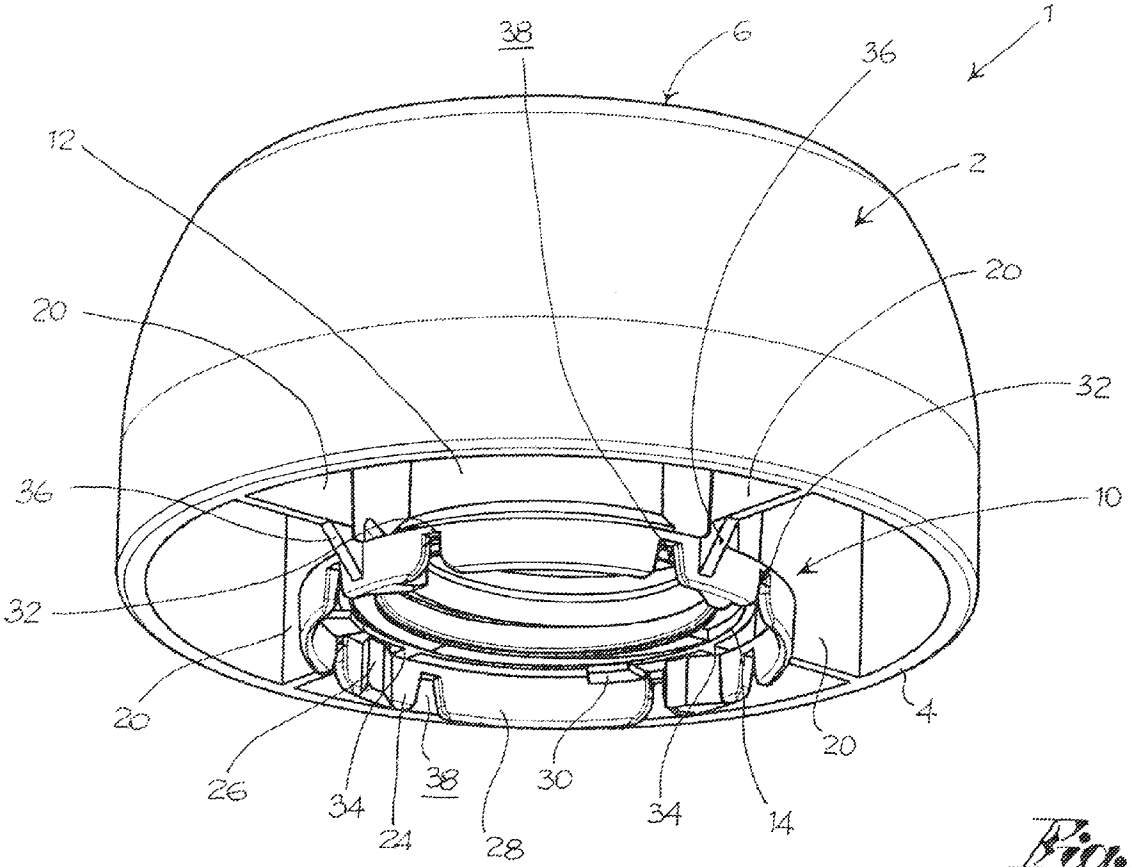
FIG. 1 shows a perspective bottom view of the cap according to the present invention, provided with a guarantee seal in an intact seal configuration.
Figure 2:
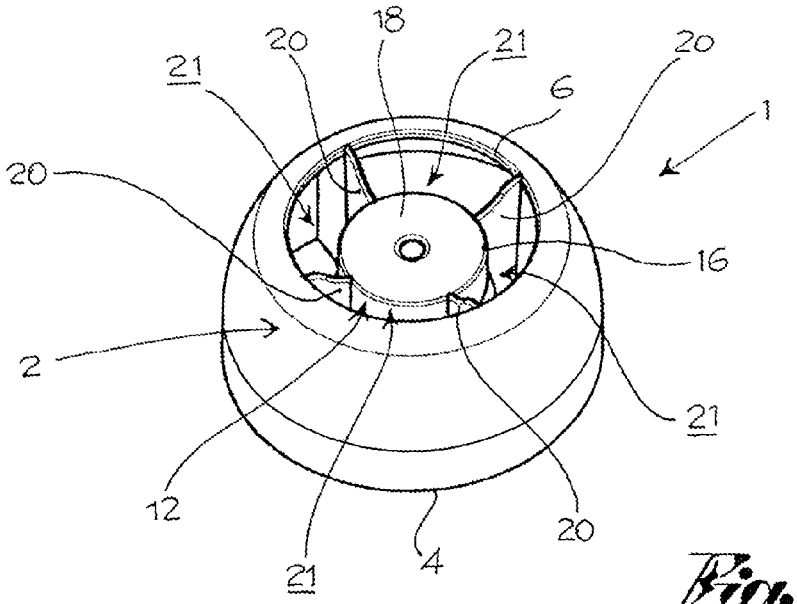
FIG. 2 shows a further perspective view of the cap of FIG. 1.
Figure 3:
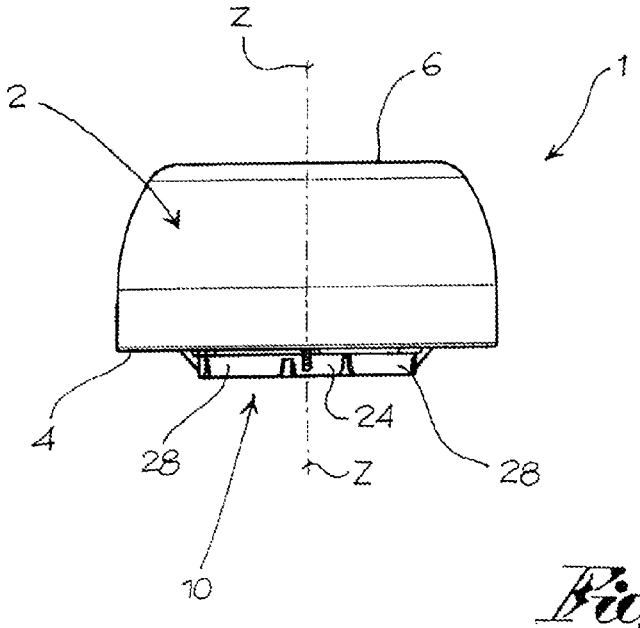
FIG. 3 shows a plan side view of the cap of FIG. 2.
Figure 4:
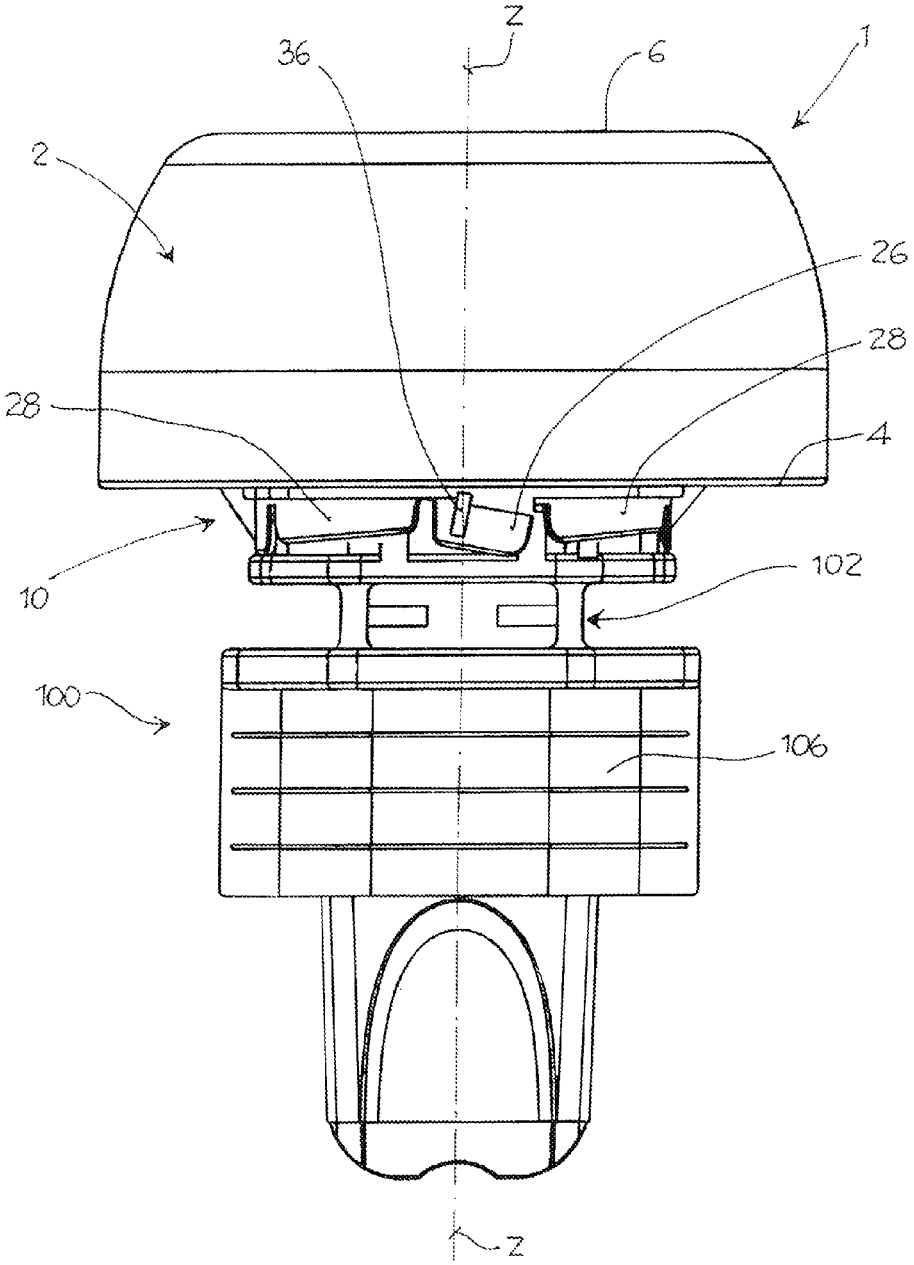
FIG. 4 shows a closing device comprising the cap according to the present invention and a coupling portion to the container, wherein the guarantee seal is in an incipient breakage configuration.
Figure 5:
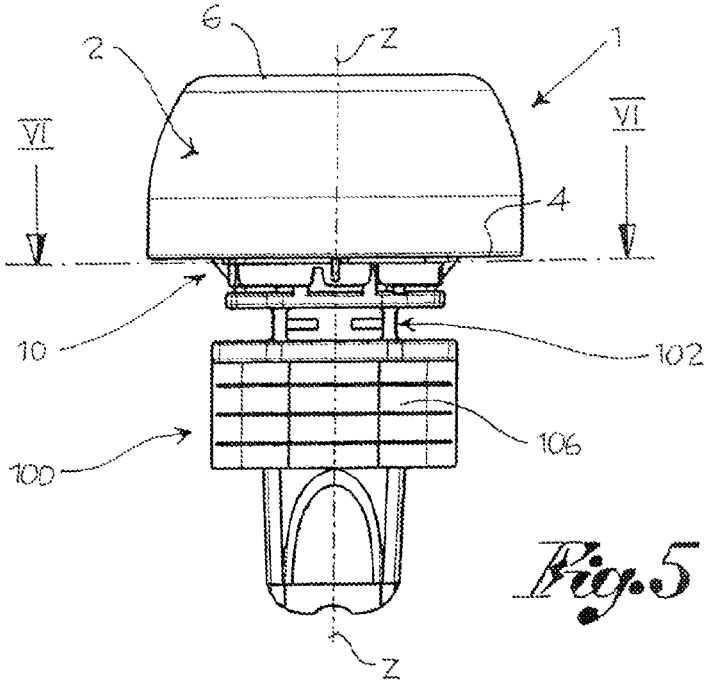
FIG. 5 shows the closing device of FIG. 4 in an intact seal configuration.
Figure 6:
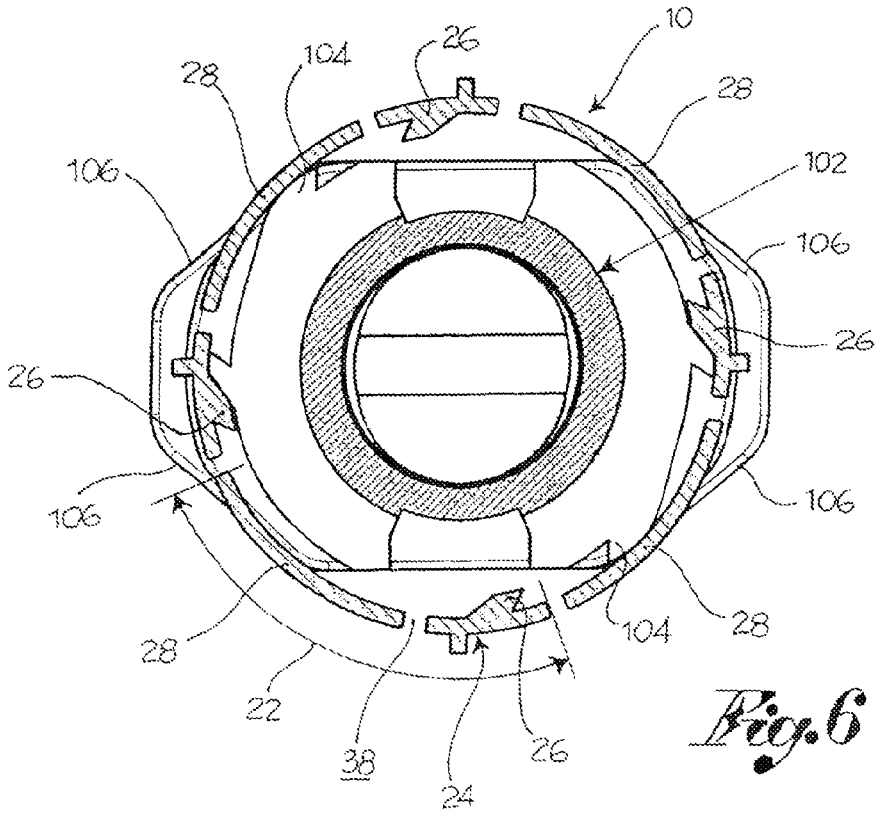
FIG. 6 shows a section view obtained according to line VI-VI of FIG. 5.
Figure 7:
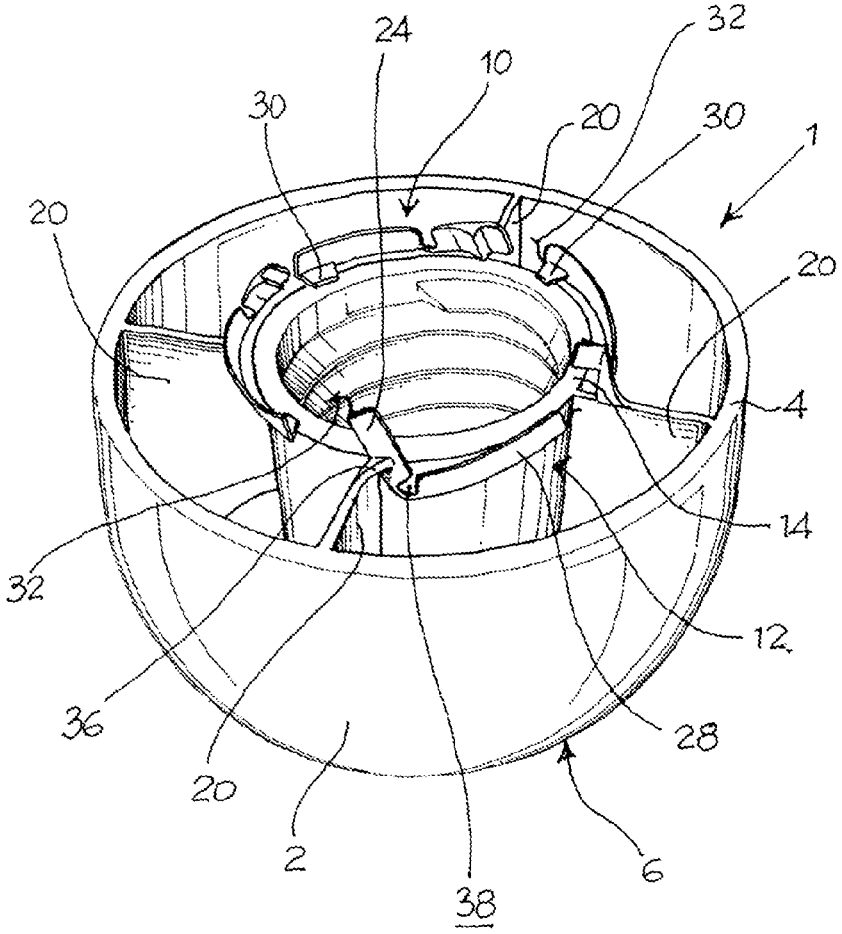
FIG. 7 shows a perspective view of the cap according to the present invention, in a broken seal configuration.
Figure 8:
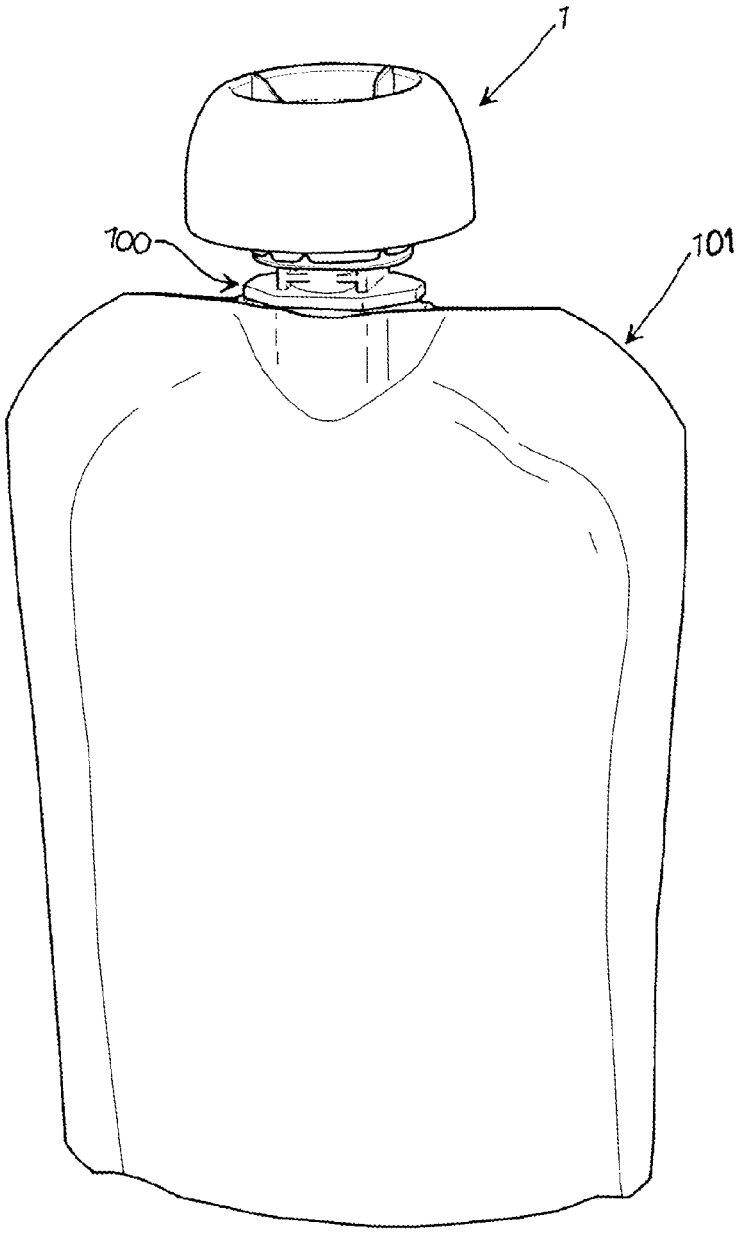
FIG. 8 shows a perspective view of the cap, coupling portion, and container according to the present invention.

With reference to the annexed figures, reference numeral 1 globally indicates a cap suitable for being associated to a coupling portion 100 of a container 101, preferably deformable.

The coupling portion 100 of the container is generally provided with a tubular straw 102, for dispensing the contents from the container, to which the cap is associable.

At the base of straw 102, the coupling portion 100 comprises at least one resistant element 104 suitable for engaging the cap for preventing the rotation thereof, at least upon the first opening of the container.

According to a preferred embodiment, the coupling portion 100 further comprises welding walls 106 for welding the portion 100 to the container walls.

Cap 1 is suitable for being disconnected from the coupling portion 100 of the container, generally by rotation about an axis of rotation Z-Z, and comprises a guarantee seal 10 which, upon the first opening of the container, that is, upon the first unscrewing of cap 1 from the coupling portion 100, undergoes breakage that proves the occurrence of the opening.

Cap 1 comprises a handling portion 2 suitable for being rotated by a user for disconnecting cap 1 from the container.

According to a preferred embodiment, the handling portion 2 extends axially from a bottom edge 4, close to the guarantee seal 10, to an upper edge 6. In particular, the guarantee seal 10 axially protrudes underneath the lower edge 4 of the handling portion 2.

Preferably, moreover, the lower edge 4 of the handling portion 2 radially extends externally to the guarantee seal 10.

According to a preferred embodiment, moreover, cap 1 comprises an inner annular wall 12, for example internally threaded for allowing the screwing and/or unscrewing of cap 1 from the coupling portion 100.

The inner annular wall 12 axially extends between a lower edge 14, close to the guarantee seal 10, and an upper edge 16.

Cap 1 further comprises a closing bottom 18, arranged at the upper edge 16 of the inner annular wall 12, for closing thereof and thereby the container.

According to a preferred embodiment, moreover, cap 1 comprises at least one tongue 20, for example flat, arranged on a longitudinal plane passing by the axis of rotation Z-Z of the cap. In particular, cap 1 comprises four tongues 20, arranged angularly equally spaced.

The tongues 20 connect the handling portion 2 to the inner annular wall 12.

According to a preferred embodiment, the cap comprises safety passages 21 passing through the outer enclosure of the cap, for example through the handling portion 2.

Advantageously, the safety passages allow the passage of air through the handling portion in the event the cap, while meeting the strictest standards envisaged on this subject, is accidentally swallowed.

According to a preferred embodiment, the safety passages 21 are obtained between the tongues 20 for the connection between the handling portion 2 and the inner annular wall 12.

The guarantee seal 10, which extends as a tape annularly about the axis of rotation Z-Z, comprises a plurality of guarantee portions 22, connected to one another in an intact seal configuration, that is, prior to the first opening of the container, and separate from each other in a broken seal configuration, that is, after the first opening of the container.

The guarantee portion 22 comprises an engagement portion 24 having at least one engagement element 26 suitable for engaging with the resistant elements 104 of the coupling portion 100, for preventing the rotation of the guarantee seal.

Moreover, the guarantee portion 22 comprises a connecting portion 28, connected to the engagement portion 24 and having at least one connecting element 30 which makes the connecting portion 28 integral to the handling portion 2.

Moreover, the guarantee seal comprises at least one bridge 32 that connects the guarantee portions 22 to one another. The bridge 32 is suitable for breaking by rotation of the handling portion 2 relative to the guarantee seal 10.

The guarantee seal 22 further comprises a safety portion 34 that makes the engagement portion 24 integral with the handling portion 2. The safety portion 34 is structurally suitable for keeping the engagement portion 24 connected to the handling portion 2 in the broken seal configuration.

In other words, even when the guarantee seal undergoes breakage, thus indicating the occurrence of the opening of the container, the safety portion 34 keeps the engagement portion 24 constrained, so as not to form dangerous spikes.

Moreover, for higher safety, according to a preferred embodiment, the safety portion 34 comprises a reinforcing element 36 that connects the safety portion 34 to tongue 20.

Preferably, moreover, a loop 38 is obtained between the engagement portion 24 and the connecting portion 28, which advantageously allows settling the engagement portion 24 and the connecting portion 28 in the broken seal configuration.

Innovatively, the cap according to the present invention is especially safe, especially to be used by children.

In particular, even when detached from one another due to the tearing undergone by the bridges which makes them break, the guarantee portions maintain a limited length, so as not to form dangerous spikes.

Advantageously, moreover, the guarantee portions are strongly constrained to the inner annular wall, so as to not be torn away, for example with the mouth.

What is claimed is:

1. A cap suitable for being associated to a coupling portion of a container and suitable for being disconnected by rotation about an axis of rotation from the coupling portion, wherein the coupling portion comprises resistant elements suitable for engaging the cap; and wherein the cap comprises:

a handling portion suitable for being rotated by a user for disconnecting the cap from the container;

a guarantee seal, integral with the handling portion and comprising a plurality of guarantee portions, wherein the seal exhibits breaks in a broken seal configuration;

an inner annular wall axially extended between a lower edge, close to the guarantee seal, and an upper edge;

a closing bottom arranged at the upper edge, for closing the inner annular wall;

wherein the inner annular wall is integral with the handling portion and the lower edge of the inner annular wall is radially internal to the guarantee seal;

wherein at least one of the guarantee portions comprises:

an engagement portion having at least one engagement element suitable for engaging with the resistant elements of the coupling portion for preventing the rotation of the guarantee seal;

a connecting portion, connected to the engagement portion, having at least one connecting element which makes the connecting portion integral to the handling portion; and wherein the guarantee seal comprises at least one bridge which connects adjacent guarantee portions to one another, the bridge being suitable for breaking by rotation of the handling portion relative to the guarantee seal;

wherein the guarantee seal further comprises a safety portion that makes the engagement portion integral with the handling portion, the safety portion being structurally suitable for keeping the engagement portion constrained in the broken seal configuration; and wherein the safety portion connects the engagement portion of the guarantee seal with the inner annular wall.

2. A cap suitable for being associated to a coupling portion of a container and suitable for being disconnected by rotation about an axis of rotation from the coupling portion, wherein the coupling portion comprises resistant elements suitable for engaging the cap; and wherein the cap comprises:

a handling portion suitable for being rotated by a user for disconnecting the cap from the container;

a guarantee seal attached to the handling portion and comprising a plurality of guarantee portions, wherein the seal exhibits breaks in a broken seal configuration;

an inner annular wall axially extended between a lower edge, close to the guarantee seal, and an upper edge;

a closing bottom arranged at the upper edge, for closing the inner annular wall;

wherein the inner annular wall is attached to the handling portion and the lower edge of the inner annular wall is radially internal to the guarantee seal;

wherein at least one of the guarantee portions comprises an engagement portion having at least one engagement element suitable for engaging with a resistant element of the coupling portion for resisting the rotation of the guarantee seal;

wherein the guarantee seal comprises at least one bridge which connects adjacent guarantee portions to one another, the bridge being suitable for breaking by rotation of the handling portion;

wherein the guarantee seal further comprises a safety portion that makes the engagement portion integral with the handling portion, the safety portion being structurally suitable for keeping the engagement portion constrained in the broken seal configuration;

wherein the handling portion extends annularly about the inner annular wall, radially spaced therefrom, and axially between a bottom edge, close to the guarantee seal, and a top edge; and wherein at least one tongue connects the handling portion to the inner annular wall.

3. The cap according to claim 2, wherein the safety portion connects the engagement portion of the guarantee seal with the lower edge of the inner annular wall.

4. The cap according to claim 2, comprising safety passages passing through the cap.

5. The cap according to claim 4, wherein the safety passages are obtained through the handling portion.

6. A cap suitable for being associated to a coupling portion of a container and suitable for being disconnected by rotation about an axis of rotation from the coupling portion, wherein the coupling portion comprises resistant elements suitable for engaging the cap; and wherein the cap comprises:

a handling portion suitable for being rotated by a user for disconnecting the cap from the container;

a guarantee seal, integral with the handling portion and comprising a plurality of guarantee portions, wherein the seal exhibits breaks in a broken seal configuration;

an inner annular wall axially extended between a lower edge, close to the guarantee seal, and an upper edge;

a closing bottom arranged at the upper edge, for closing the inner annular wall;

wherein the inner annular wall is integral with the handling portion and the lower edge of the inner annular wall is radially internal to the guarantee seal;

wherein at least one of the guarantee portions comprises:

an engagement portion having at least one engagement element suitable for engaging with the resistant elements of the coupling portion for preventing the rotation of the guarantee seal;

a connecting portion, connected to the engagement portion, having at least one connecting element which makes the connecting portion integral to the handling portion; and wherein the guarantee seal comprises at least one bridge which connects adjacent guarantee portions to one another, the bridge being suitable for breaking by rotation of the handling portion relative to the guarantee seal;

wherein the guarantee seal further comprises a safety portion that makes the engagement portion integral with the handling portion, the safety portion being structurally suitable for keeping the engagement portion constrained in the broken seal configuration;

wherein the handling portion extends annularly about the inner annular wall, radially spaced therefrom, and axially between a bottom edge, close to the guarantee seal, and a top edge; and wherein the bottom edge radially extends externally to the guarantee seal.

7. The cap according to claim 6, further comprising the coupling portion having a tubular straw.

8. The cap according to claim 7, wherein the coupling portion further comprises the container attached to the coupling portion.

9. A cap suitable for being associated to a coupling portion of a container and suitable for being disconnected by rotation about an axis of rotation from the coupling portion, wherein the coupling portion comprises resistant elements suitable for engaging the cap; and wherein the cap comprises:

a handling portion suitable for being rotated by a user for disconnecting the cap from the container;

a guarantee seal, integral with the handling portion and comprising a plurality of guarantee portions, wherein the seal exhibits breaks in a broken seal configuration;

an inner annular wall axially extended between a lower edge, close to the guarantee seal, and an upper edge;

a closing bottom arranged at the upper edge, for closing the inner annular wall;

wherein the inner annular wall is integral with the handling portion and the lower edge of the inner annular wall is radially internal to the guarantee seal;

wherein at least one of the guarantee portions comprises:

an engagement portion having at least one engagement element suitable for engaging with the resistant elements of the coupling portion for preventing the rotation of the guarantee seal;

a connecting portion, connected to the engagement portion, having at least one connecting element which makes the connecting portion integral to the handling portion; and wherein the guarantee seal comprises at least one bridge which connects adjacent guarantee portions to one another, the bridge being suitable for breaking by rotation of the handling portion relative to the guarantee seal; and wherein the guarantee seal further comprises a safety portion that makes the engagement portion integral with the handling portion, the safety portion being structurally suitable for keeping the engagement portion constrained in the broken seal configuration;

wherein the handling portion extends annularly about the inner annular wall, radially spaced therefrom, and axially between a bottom edge, close to the guarantee seal, and a top edge; and at least one tongue which connects the handling portion to the inner annular wall.

10. The cap according to claim 9, wherein the tongue is flat and laying on a longitudinal plane passing through the axis of rotation.

11. The cap according to claim 9, wherein the tongues are in a number of four, angularly equally spaced.

12. The cap according to claim 9, wherein the safety portion of the guarantee seal comprises a reinforcing element that connects the engagement portion to the tongue.

13. A cap suitable for being associated to a coupling portion of a container and suitable for being disconnected by rotation about an axis of rotation from the coupling portion, wherein the coupling portion comprises resistant elements suitable for engaging the cap; and wherein the cap comprises:

a handling portion suitable for being rotated by a user for disconnecting the cap from the container;

a guarantee seal, integral with the handling portion and comprising a plurality of guarantee portions, wherein the seal exhibits breaks in a broken seal configuration;

wherein at least one of the guarantee portions comprises:

an engagement portion having at least one engagement element suitable for engaging with the resistant elements of the coupling portion for preventing the rotation of the guarantee seal;

a connecting portion, connected to the engagement portion, having at least one connecting element which makes the connecting portion integral the handling portion; and wherein the guarantee seal comprises at least one bridge which connects adjacent guarantee portions to one another, the bridge being suitable for breaking by rotation of the handling portion relative to the guarantee seal;

wherein the guarantee seal further comprises a safety portion that makes the engagement portion integral with the handling portion, the safety portion being structurally suitable for keeping the engagement portion constrained in the broken seal configuration; and wherein a loop is obtained between the engagement portion and the connecting portion of the guarantee seal for settling the engagement portion and the connecting portion with broken seal.

14. The cap according to claim 2, wherein the inner annular wall is internally threaded for allowing the screwing and/or unscrewing from the coupling portion of the container.

15. The cap according to claim 2, further comprising the coupling portion having a tubular straw.

16. The cap according to claim 15, wherein the coupling portion further comprises the container attached to the coupling portion.

* * * * *